US007213355B2

(12) United States Patent
Aires

(10) Patent No.: US 7,213,355 B2
(45) Date of Patent: May 8, 2007

(54) DISPLAY BANNER

(76) Inventor: Gary Aires, 10401 Roselle St., #206, San Diego, CA (US) 92121

( * ) Notice: Subject to any disclaimer, the term of this patent is extended or adjusted under 35 U.S.C. 154(b) by 322 days.

(21) Appl. No.: 11/015,886

(22) Filed: Dec. 17, 2004

(65) Prior Publication Data

US 2006/0130380 A1 Jun. 22, 2006

(51) Int. Cl.
*G09F 17/00* (2006.01)

(52) U.S. Cl. ..... 40/604; 40/606.12

(58) Field of Classification Search ..... 40/604, 40/606.01, 606.12, 603, 607.05, 607.06, 40/538, 610, 611.01, 611.12, 218
See application file for complete search history.

(56) References Cited

U.S. PATENT DOCUMENTS 4,347,862 A * 9/1982 Secon ..... 135/20.1
5,572,945 A * 11/1996 Eastaugh ..... 116/173
6,289,839 B1 * 9/2001 Flores ..... 116/173

FOREIGN PATENT DOCUMENTS

ZA 97/10535 * 8/1998

* cited by examiner

*Primary Examiner*—Lesley D. Morris
*Assistant Examiner*—Shin Kim
(74) *Attorney, Agent, or Firm*—Frank G. Morkunas

(57) ABSTRACT

A display banner having connectable pole sections, some of which are flexible, insertable into a sleeve on a sheet shaped like a half-heart such that, when the assembled pole sections are so inserted, the pole sections form a J-shape or fish-hook shape and retain the sheet taut to the assembled pole. An anchor assembly receives the assembled display banner into a rotatable stem thereby permitting the display banner to rotate freely.

9 Claims, 3 Drawing Sheets

DISPLAY BANNER

CROSS REFERENCES TO RELATED APPLICATIONS

None.

STATEMENT REGARDING FEDERALLY-SPONSORED RESEARCH OR DEVELOPMENT

Not applicable.

BACKGROUND OF THE INVENTION

This present invention relates to an improvement in display flags and display banners, and more particularly to such flags and banners so configured to retain a specific one-half heart shape or "fish-hook" shape, be easily secured to an external ground surface, and rotate or swivel while secured to the external ground surface to clearly display the message of the flag/banner a full 360°.

The foregoing has outlined some of the more pertinent objects of the present invention. These should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The present invention contemplates a display banner having a sheet which has a J-shaped hem and a half-heart overall shape, a J-shaped sleeve shorter than the hem, a flexible pole assembly insertable into the sleeve to thereby firmly attain and retain the shape of the sheet, and a swivelable anchor assembly as a foundation for the display banner into/onto which the pole assembly secures and rotates freely.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
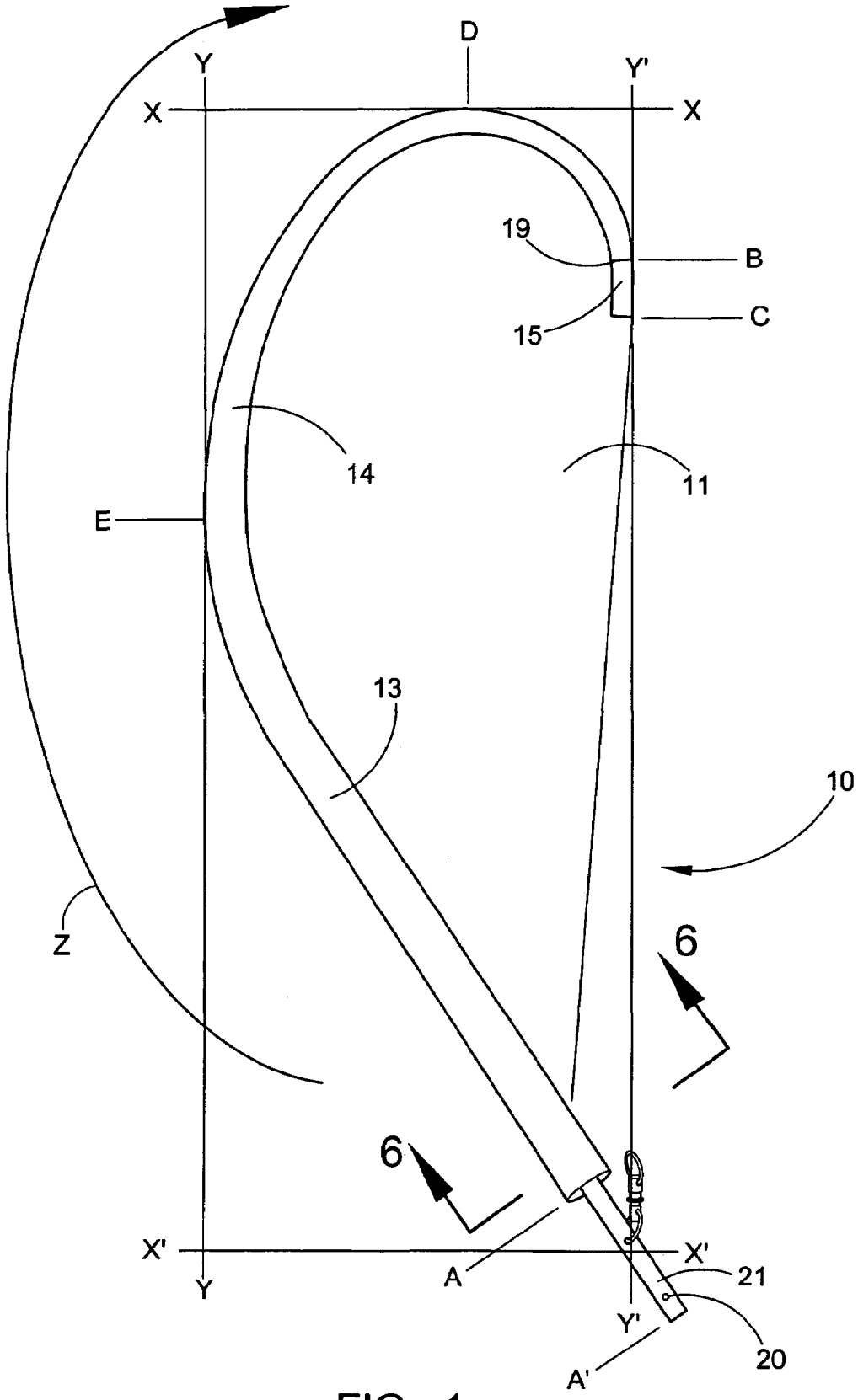
FIG. 1 is plan view of the display banner configuration.

Referring now to the drawings in detail and in particular to FIG. 1, reference character 10 generally designates a display banner constructed in accordance with a preferred embodiment of the present invention. The display banner 10 has a sheet 11 which has a wide hem 14 which is J-shaped or fish-hook shaped [referred to hereafter as "J" or J-shaped] and rotated approximately 135° clockwise off the Y'—Y' axis as shown. The hem 14 originates [and has its linear terminus] at Point A, is configured upward in the direction of Arrow Z to Point E, arcs around past Points D and B to Point C [its curvilinear terminus]. At this point the wide hem 14 terminates. The shape of the sheet 11 continues downward back to Point A thereby defining its perimeter, shape, and area.

A sleeve 13 is inside the hem 14. The sleeve 13 has a shorter length than the hem 14. The sleeve originates at Point A, is relatively straight on the linear part of the J-shape, arcs around clockwise and terminates at the sleeve termination point 19 [Point B]. An end tab or grip tab 15 is defined between Points B and C.

For administrative clarity, FIG. 1 illustrates the J-shape of the hem 14 rotated approximately 135° clockwise off the Y'—Y' axis and the half-heart shape of the sheet 11 in a rectangular grid defined by horizontal plane X—X at the top, horizontal plane X'—X' at the bottom, vertical plane Y—Y to the left side, and vertical plane Y'—Y' to the right side. Also illustrated in FIG. 1 is the pole 21 inserted into and attached to the sheet 11 by retaining components to be described later. The overall length [L] of the pole 21 should be greater than the distance represented from Point B running counter-clockwise and down past Point A to Point A'.

Figures 2, 3, 4:
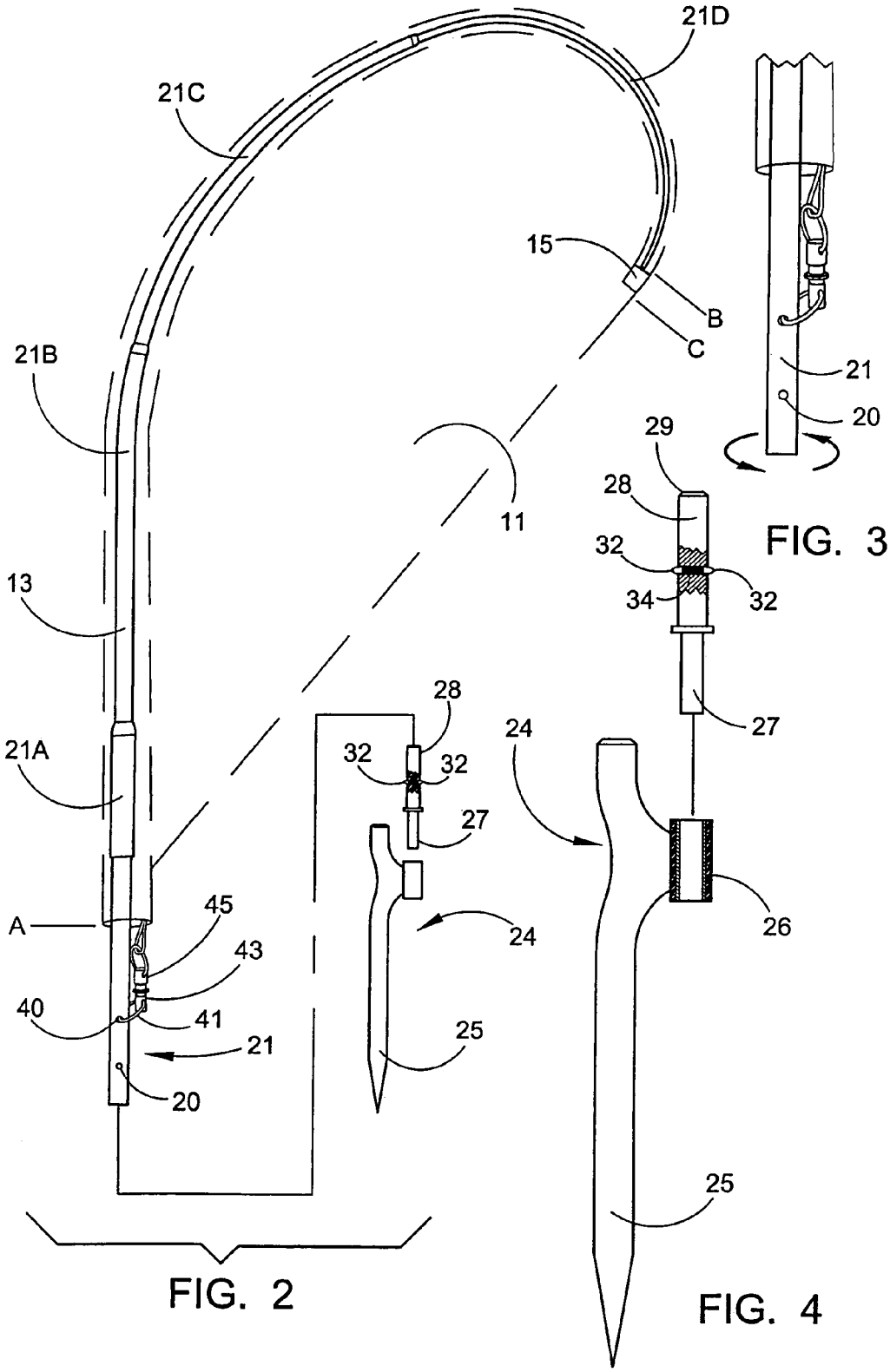
FIG. 2 is an elevation view of the complete display banner with anchor component.
FIG. 3 is a detailed view of the bottom end of the pole section.
FIG. 4 is a detailed view of the anchoring component of the display banner.

Once the display banner 10 is properly constructed and placed, the pole 21 generally will be vertically disposed such that the linear section of the J-shape is rotated approximately 45° clockwise; i.e., the "J" is placed upside-down or rotated in either direction approximately 180° as illustrated in FIG. 2. FIG. 2 also shows the pole 21 after the pole has been assembled and slid into the sleeve 13. The pole 21 is comprised of more than one section. As illustrated here the pole 21 has pole sections 21A–21D. The pole sections 21A–21D may be somewhat flexible with the pole sections farthest from the bottom and from the bottom-most pole sections being more flexible and with the top pole section being the most flexible.

Figure 5:
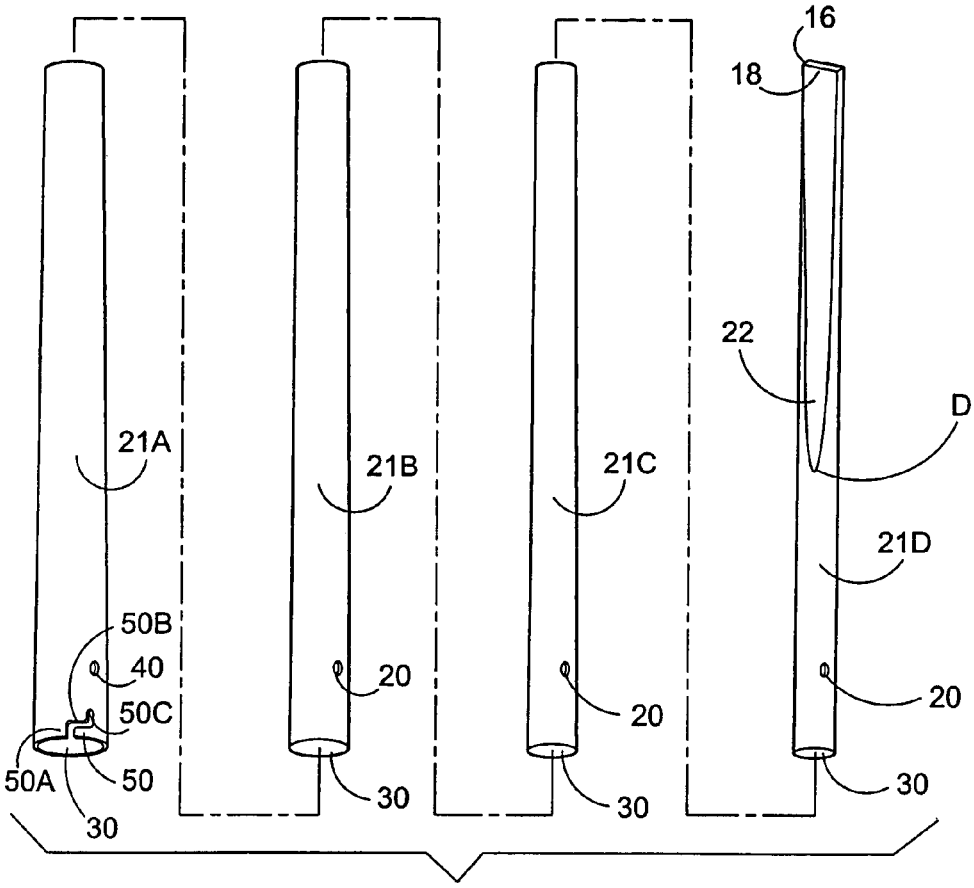
FIG. 5 is a detailed view of the pole of the display banner and its sectional pole section components.

FIG. 5 illustrates the pole sections 21A–21D. Each pole section has a mouth 30 at its respective bottom end and may have an anchor receiving aperture 20 near its respective bottom end. The top pole section 21 has a relatively flattened extension 22 wherein the width 18 [WD] is greater that its depth 16 [DP]. Generally WD is approximately 3 to 10 times greater than DP and the extension 22 comprises between approximately 50% to 75% of the overall length of the top pole section 21D. This extension 22 also is represented by Points B to D. These reference points also related to Points B and D of FIG. 1.

The flattened extension 22 allows for maximum curvature of the pole 21 when assembled, slid through the sleeve 13, and the sheet 11 pulled taut and fastened to the bottom pole section adjacent to its sheet receiving aperture 40. This structure of the top pole section 21D maximizes the bendability or flexibility of the entire pole structure 21 when fully assembled which is necessary for the display banner 10 to attain and retain its shape, as described above, after the pole 21 is inserted into the sleeve 13.

Figure 6:
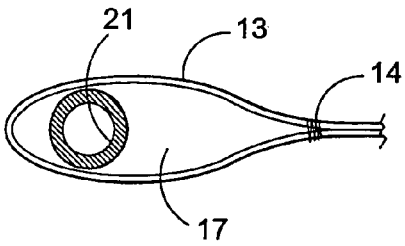
FIG. 6, taken on line 6—6 of FIG. 1, is a cross-section view of the pole inside the sleeve.

As described earlier, all the poles sections have an anchor receiving aperture 40 near their respective bottom end. In another embodiment illustrated in FIG. 5, each may instead, or in addition to, have a receiving channel 50. The receiving channel has a least three directional channels. As the pole section is viewed in its upstanding position, the receiving channel 50 have a upward or forward vertical channel 50A, a horizontal channel 50B, and a second forward vertical channel 50C. FIG. 6 illustrates the pole 21 inside the sleeve channel 17 of the sleeve 13.

After proper construction of the display banner 10 [pole sections 21A–21D connected and sheet 11 slid onto the assembled pole 21], the pole 21 is inserted onto the anchor post 24. In FIG. 4 the anchor post 24 generally has an elongated stake member 25 for insertion into the ground and has a swivel component 26 into which a rotatable stem 27 is securely and rotatable fitted. A stem extension 28 extends upward from the swivel component 26 terminating at a flanged or beveled end 29. One or more detents 32 are on the stem extension 28.

The bottom pole section 21A is slid over the extension 28. The receiving aperture 20 of that bottom pole section 21A mates with a detent 32 and is held securely to the anchor post 24 thereby. For ease of attachment and removal, the detents 32 on the extension 28 are biased with biasing mechanism 34 internal to the extension 28. Typical biasing components such as, but not limited to, conventional compression springs, are suitable to the intended purpose.

Figure 8:
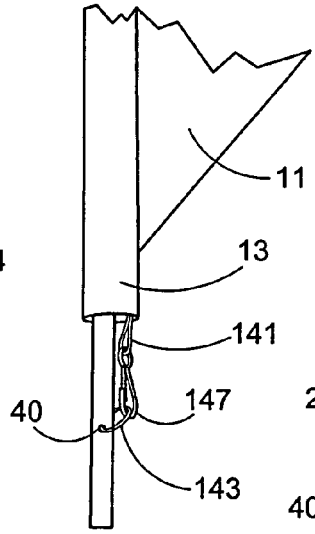
FIG. 8, is a detailed view of a second embodiment of the retaining component of the display banner.
Figure 7:
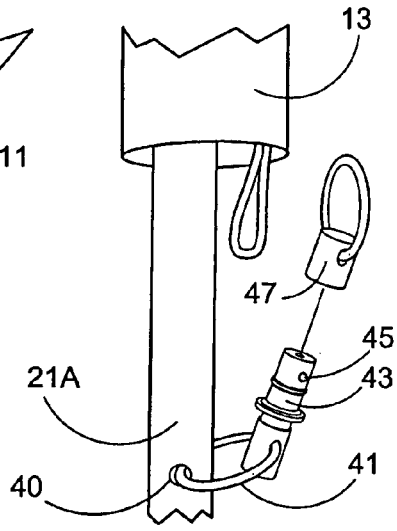
FIG. 7, is a detailed view of the retaining component of the display banner.

FIGS. 7 and 8 illustrate two embodiments of the retaining component adapted to tautly retain the sheet 11 to the respective pole section 21A adjacent to the bottom of the pole. An elastic member 41 is attached to aperture 40 and also has thereon a releaseable coupling member 43 [illustrated here as a male coupler]. A corresponding second releaseable coupling 47 [illustrated here as a female coupler] is attached to the sheet 11 at approximately Point A. It must be understood that either male or female coupler may interchangeably be structured to be on sheet 11 or to be on the pole 21. The male coupling member 43 has a compressible detent 45 which mates with a corresponding aperture [not shown] in the female coupler 47. Such coupling and uncoupling devices are conventionally available and suited for the intended purpose.

In FIG. 8 the retaining component comprises a ring-like element 143 in the aperture 40. An elastic member 141 is on the sheet 11 at approximately Point A. A conventional biased eye clip or hook clip with a biased spring bar 147 is attached to the elastic member 141. In operation, after the pole 21 is assembled and gathered through the sleeve 13, the user should grasp grip tab 15 while holding the distal end of the flat section 22, pull down to cause the curvature represented by and from and through Points B, D, and E. While maintaining that configuration, the retaining component on the sheet 11 is connected to the coupling member 43 with mating coupling member 45 or connected to the ring 141 with clip 147. After so coupled, the display banner 10 will retain the shape represented in FIGS. 1 and 2. The elastic member 41, 141 facilitates the coupling and serves as an enhancement to the display banner 10 as the wind strikes the sheet 11 and causes the display banner 10 to rotate freely in the anchor post 24.

To attain and retain the desired half-heart shape, the following approximate ratios in as described in length-units [LU] are necessary [length-units are any unit of distance or length measurement; i.e., millimeters, centimeters, inches, or feet]:

As measured following directional Arrow Z:

A to B between approximately 100 to 120 LU;

A to C between approximately 102 to 126 LU;

B to C between approximately 2 to 6 LU;

D to B between approximately 15 to 40 LU;

A' to B [L] between approximately 100 to 160 LU;

The length of the pole sections 21A–21D may range from approximately 20 LU to approximately 60 LU.

Best results have been found with the following LU:

A to B between approximately 106 to 110 LU;

A to C between approximately 108 to 115 LU;

B to C between approximately 2 to 4 LU;

D to B between approximately 24 to 32 LU;

A' to B [L] between approximately 110 to 120 LU; and

Pole section length of approximately 34–38 LU.

The present disclosure includes that contained in the present claims as well as that of the foregoing description. Although this invention has been described in its preferred form with a certain degree of particularity, it is understood that the present disclosure of the preferred form has been made only by way of example and numerous changes in the details of construction and combination and arrangement of parts and method steps may be resorted to without departing from the spirit and scope of the invention. Accordingly, the scope of the invention should be determined not by the embodiment[s] illustrated, but by the appended claims and their legal equivalents.

The invention claimed is:

1. A display banner comprising:

(a) a sheet having a J-shaped hem wherein said hem's linear terminus is at a point A and its curvilnear terminus is at a point C and wherein said sheet comprises a planar shape of point A to point C to point A;

(b) a sleeve on said hem originating at point A and terminating at point a B wherein point B is less than a distance from point A to point C;

(c) a grip tab on said hem wherein said grip tab originates at point C and terminates at point B; and (d) a pole comprising a plurality of pole sections and a top section, each of said plurality of pole sections and said top section having a top end and a bottom end with a mouth at said bottom end, wherein said mouth of said top section and said mouth of one of said plurality of pole sections are connectable to said top end of any one of said plurality of pole sections, and wherein said top end of said top section comprises a flat bendable extension, wherein said pole is insertable into said sleeve at point A and to point B, top section first.

2. The display banner of claim 1 further comprises a retaining component on said sheet and on said pole.

3. The display banner of claim 2 wherein retaining component comprises:

(a) an aperture on said pole;

(b) an elastic member through said aperture;

(c) a releaseable coupling member having a first section attached to said elastic member and a second section attached to said sheet at point A.

4. The display banner of claim 1 further comprising an anchor post having a pole receiving member onto which said pole is insertable.

5. The display banner of claim 4 wherein said pole receiving member comprises one or more detents and said bottom end of said plurality of pole sections comprises one or more corresponding apertures through which one or more of said one or more detents engage.

6. The display banner of claim 5 wherein said one or more detents are retractable.

7. The display banner of claim 4 wherein said pole receiving member comprises one or more detents and said bottom end of said plurality of pole sections comprises one or more receiving channels for said one or more detents, wherein said one or more receiving channels comprise a forward channel, followed by a horizontal channel, followed by a second forward channel.

8. The display banner of claim 4 wherein said pole receiving member is swivelable.

9. The display banner of claim 4 wherein said pole receiving member comprises an elongated stake insertable into an external ground surface.

* * * * *